US008452219B2

(12) United States Patent
Izawa et al.

(10) Patent No.: US 8,452,219 B2
(45) Date of Patent: May 28, 2013

(54) ELECTROPHOTOGRAPHIC PRINTER

(75) Inventors: Hideo Izawa, Sakura (JP); Junichi Setoyama, Yachimata (JP)

(73) Assignee: Miyakoshi Printing Machinery Co., Ltd. (JP)

( * ) Notice: Subject to any disclaimer, the term of this patent is extended or adjusted under 35 U.S.C. 154(b) by 231 days.

(21) Appl. No.: 12/844,359

(22) Filed: Jul. 27, 2010

(65) Prior Publication Data

US 2011/0026991 A1 Feb. 3, 2011

(30) Foreign Application Priority Data

Jul. 29, 2009 (JP) ..... P2009-176742

(51) Int. Cl.
*G03G 15/20* (2006.01)

(52) U.S. Cl.
USPC ..... 399/336; 399/33; 399/320

(58) Field of Classification Search
USPC ..... 399/33, 320–336
See application file for complete search history.

(56) References Cited

U.S. PATENT DOCUMENTS

| | | | | |
|---|---|---|---|---|
| 5,126,781 | A | 6/1992 | Tomizawa et al. | |
| 5,177,554 | A | 1/1993 | Oda et al. | |
| 5,561,503 | A * | 10/1996 | Masuda | 399/155 |
| 5,809,388 | A | 9/1998 | Inada | |
| 6,777,154 | B2 * | 8/2004 | Takahashi et al. | 430/114 |
| 2008/0095558 | A1 | 4/2008 | Schleusener | |
| 2009/0016786 | A1 * | 1/2009 | Suzuki et al. | 399/307 |
| 2009/0022525 | A1 * | 1/2009 | Martin et al. | 399/298 |

FOREIGN PATENT DOCUMENTS

| | | | |
|---|---|---|---|
| JP | 1-188884 | A | 7/1989 |
| JP | 2-17760 | U | 2/1990 |
| JP | 2-51353 | U | 4/1990 |
| JP | 4-16863 | A | 1/1992 |
| JP | 06-194969 | * | 7/1994 |
| JP | 7-234597 | A | 9/1995 |
| JP | 2003-98864 | A | 4/2003 |
| JP | 2004-109154 | A | 4/2004 |
| JP | 2005-338303 | A | 12/2005 |
| JP | 2008-512711 | A | 4/2008 |
| WO | 2006/027264 | A1 | 3/2006 |

OTHER PUBLICATIONS

European Search Report for European Application No. 10170576.2-2209 dated Oct. 28, 2010.
Notice of Reasons for Rejection for Japanese Patent Application No. 2009-176742 mailed Jul. 12, 2011 with English translation.
Notice of Reasons for Rejection for Japanese Application No. 2009-176742, mailed Mar. 13, 2012, with English translation.

* cited by examiner

*Primary Examiner* — Walter L Lindsay, Jr.
*Assistant Examiner* — Roy Y Yi
(74) *Attorney, Agent, or Firm* — Cantor Colburn LLP

(57) ABSTRACT

An electrophotographic printer is configured such that an infrared heater is installed at a position between a plurality of electrophotographic print units installed in of the flow direction of a recording material, and a part (an inter-unit extension part) situated between print units of the recording material is irradiated with infrared light from the infrared heater to perform a partial evaporative removal of a carrier liquid of the recording material and a partial fixing of a toner.

15 Claims, 3 Drawing Sheets

ELECTROPHOTOGRAPHIC PRINTER

BACKGROUND OF THE INVENTION

1. Field of the Invention

The present invention relates to an electrophotographic printer. In particular, the present invention relates to a wet type electrophotographic printer that uses a developing liquid composed of a liquid toner and a carrier liquid.

Priority is claimed on Japanese Patent Application No. 2009-176742, filed Jul. 29, 2009, the content of which is incorporated herein by reference.

2. Description of Related Art

In a wet type electrophotographic printer that uses a developing liquid composed of a liquid toner (hereinafter, also called merely "toner") and a carrier liquid, a type which transfers toner image formed on an outer periphery surface of a photoconductor drum onto a print surface of a paper via a transfer roller to print image is widely adopted (for example, PCT Japanese Unexamined Patent Application Publication No. 2008-512711). In this type of electrophotographic printer, the toner is fixed to the paper by performing evaporative removal of the carrier liquid, which is absorbed by the paper due to transfer of the toner image onto the paper from the transfer roller (a medium image carrier 301 in PCT Japanese Unexamined Patent Application Publication No. 2008-512711) using a heating roller or the like, for example.

Furthermore, systems are also variously proposed which are configured to pass a web (a belt-like paper) through a plurality of print units including the photoconductor drum, the transfer roller and a backup roller for pinching and pressing the paper between the transfer roller and the backup roller to conduct multi-color printing.

However, as described above, in the case of a system that passes the web through the plurality of units to form multi-color images, there is a problem in that the toner image transferred onto the web print surface in the unit at the upstream side in the web flow direction is inversely transited to the transfer roller of the downstream side unit, which causes a decline in print quality.

In regards to the inverse transition of the toner image from the web print surface to the transfer roller, it is taken into consideration that a bias voltage is applied between the transfer roller and the backup roller to secure a potential difference which makes it easy to generate the transition of the toner from the transfer roller onto the web print surface, whereby the inverse transition is prevented by the bias voltage. The configuration is effective in suppressing the inverse transition of the toner to the transfer roller, but there is a physical limitation in preventing the attachment transition of the toner to the transfer roller due to the nip pressure between the transfer roller and the backup roller. For this reason, it is necessary to develop a technique that can more securely prevent the inverse transition of the toner to the transfer roller to improve the print quality.

SUMMARY OF THE INVENTION

The present invention provides an electrophotographic printer in which inverse transition of a toner image transferred onto a web print surface in multi-color image formation or the like to a transfer roller of an electrophotographic print unit is hardly generated, which makes it possible to improve printing quality.

According to a first aspect of the present invention, an electrophotographic printer according to the present invention includes a plurality of connected electrophotographic print units that has photoconductor drums on which toner images are formed and transfer rollers which transfer the toner images of the photoconductor drums onto a recording material; and a fixing auxiliary mechanism provided between the electrophotographic print units in the flow direction of the recording material. The fixing auxiliary mechanism applies heating energy to a toner and a carrier liquid absorbed in the recording material to remove part of the carrier liquid by evaporation, and enhances the degree of fixation of the toner onto the print surface of the recording material.

According to a second aspect of the present invention, the fixing auxiliary mechanism is an infrared heater for irradiating the print surface of the recording material with infrared light.

According to a third aspect of the present invention, the infrared heater outputs infrared light with a maximum energy wavelength of 1.2 to 2.5 μm.

According to a fourth aspect of the present invention, the electrophotographic printer further includes an energy output control section that controls the output of heating energy applied to the toner and the carrier liquid of the recording material by the fixing auxiliary mechanism within a range in which the degree of fixation of the toner to the recording material by the heating energy does not disturb the image transfer onto the recording material by the electrophotographic print unit of the downstream side of the recording material flow direction of the fixing auxiliary mechanism.

According to a fifth aspect of the present invention, a bias voltage is applied between the transfer rollers and backup rollers of the electrophotographic print units.

According to a sixth aspect of the present invention, a plurality of the electrophotographic print units is provided as up/down multistage unit.

According to a seventh aspect of the present invention, the plurality of electrophotographic print units has different print colors.

According to an eighth aspect of the present invention, the electrophotographic printer according to the present invention further includes a toner fixing device that performs the drying removal of the carrier liquid and the toner fixing of the recording material in which the print by the electrophotographic print unit is completed.

According to a ninth aspect of the present invention, the toner fixing device includes a provisional fixing part and a main fixing part. The provisional fixing part has a provisional fixer installed thereon which includes an infrared heater for irradiating the print surface of the recording material transported in the electrophotographic printer with infrared light. The main fixing part has one or more main fixing units that are provided on the downstream side of the recoding material flow direction of the provisional fixing part and press the recording material by a plurality of rollers including a heating roller while pinching the recording material therebetween.

According to the present invention, the heating energy is applied from the fixing auxiliary mechanism provided between the electrophotographic print units (hereinafter, also called merely "print unit") along the recording material flow direction to the carrier liquid and the toner absorbed in the recording material in which the toner images have been transferred by the print unit in the upstream side of the recording material flow direction from the fixing auxiliary mechanism. In addition, it is possible to remove part of the carrier liquid by evaporation and partly progress the melting fixation of the toner onto the print surface of the recording material by means of the heating energy. As a result, the transition property (the degree of fixation) of the toner to the print surface of the recording material can be improved. Furthermore, it is possible to prevent or mostly eliminate the inverse transition of the toner image from the print surface of the recording material to the transfer roller, when the transfer roller of the print unit of the downstream side of the recording material flow direction comes in contact with the print surface of the recording material from the fixing auxiliary mechanism. Thus, the print quality can be improved.

DETAILED DESCRIPTION OF THE INVENTION

Hereinafter, an embodiment of an electrophotographic printer according to the present invention will be described with the reference to the drawings.

In addition, in FIGS. 1 to 4, descriptions will be made such that the upper side of the figure is "up" and the lower side of the figure is "down".

Figure 1:
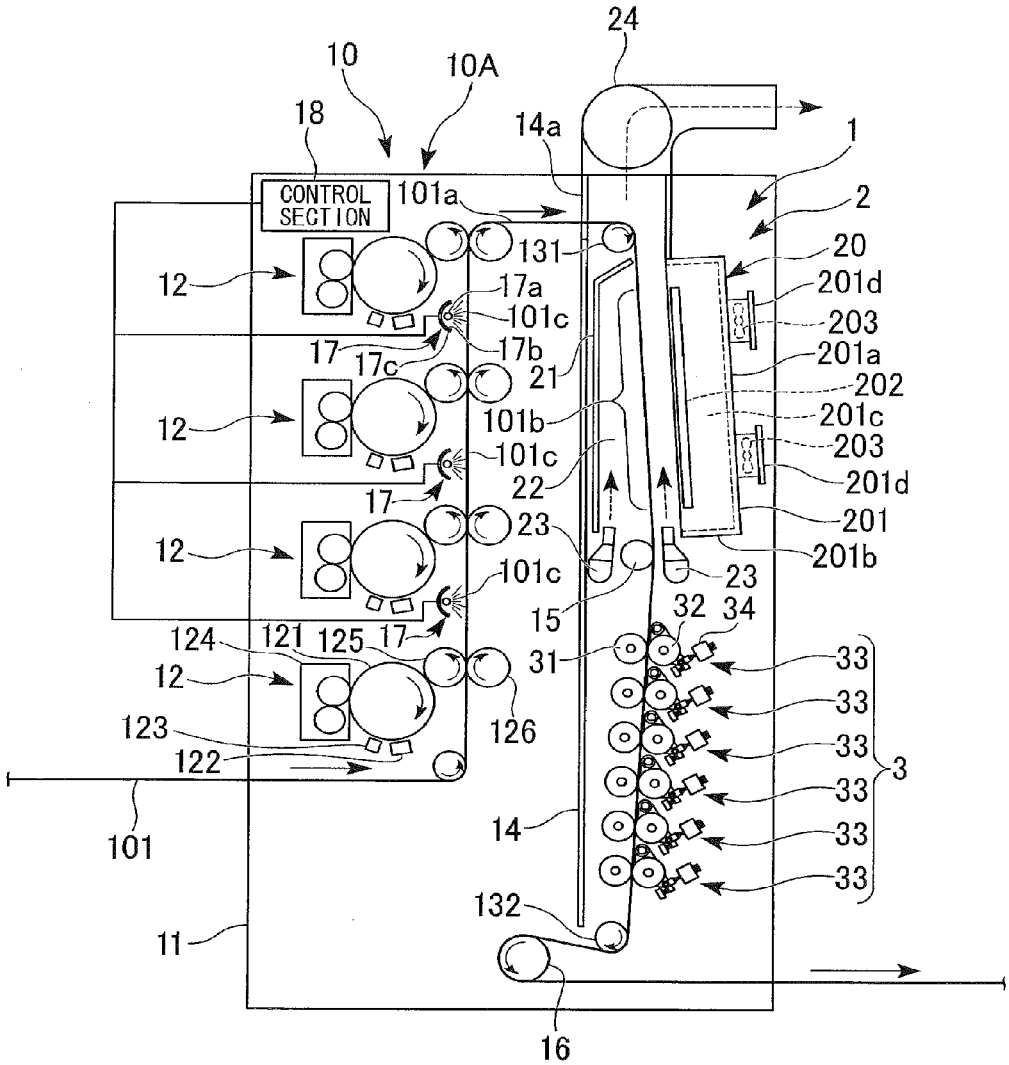
FIG. 1 is a front view showing a configuration of an electrophotographic printer according to the present invention.

An electrophotographic printer 10 as shown in FIG. 1 includes a print device part 10A and a toner fixing device 1. The print device part 10A has electrophotographic print units 12 disposed in the up and down multistage manner (four stages in the shown example) for conducting the multi-color print. The toner fixing device 1 dries a web 101 (a band-shaped paper) as a recording material after being printed in the electrophotographic print units 12 to fix the toner thereon.

In FIG. 1, reference numeral 11 is a frame of the electrophotographic printer 10 and reference numeral 14 is a partition wall.

The partition wall 14 is formed in the frame 11 so as to extend in the up and down direction and is installed so as to be interposed between the print device part 10A and the toner fixing device 1. The toner fixing device 1 is installed at the opposite side of the print device part 10A via the partition wall 14. As describe later, the partition wall 14 also function as a heat shielding wall that shields infrared light or heat discharged from an infrared heater of the toner fixing device 1 so that the infrared light or the heat does not reach the electrophotographic print unit 12.

In addition, at the upper part of the partition wall 14, a window 14*a* is formed for passing the web 101 which is moved from the uppermost electrophotographic print unit 12, in which situated at the most downstream in the transport direction (hereinafter, also called as "flow direction") of the web 101 among the up/down multistage electrophotographic print units 12, to the toner fixing device 1.

The print device part 10A includes the electrophotographic print units 12 disposed in the up/down multistage manner and infrared heaters 17 (a fixing auxiliary mechanism, an infrared light lamp) disposed between the electrophotographic print units 12 (hereinafter, also simply called "print unit") in the up and down direction. In FIG. 1, a configuration is described in which one infrared heater 17 is installed between the electrophotographic print units 12 disposed in the up/down multistage manner. However, the installation number of the infrared heater 17 between a pair of the print units 12 adjacent to each other in the up and down direction is not limited to one, but may be two or more. The print device part 10A of the electrophotographic printer 10 of the shown example includes the four levels up/down multistage print units 12, and a total of three infrared heaters 17, each of which is installed between the print units 12 adjacent to each other in the up and down direction.

The electrophotographic print units 12 are wet type electrophotographic print devices which use a developing fluid composed of the liquid toner and the carrier liquid.

The electrophotographic print unit 12 includes a photoconductor drum 121, an electric charger 122 for uniformly charging the surface of the photoconductor drum 121, an exposure device 123 that removes the electric charge of the surface of the photoconductor drum 121 charged by the electric charger 122 through the light exposure to form electrostatic latent images, a developer 124 that supplies the photoconductor drum 121 with the developing liquid to form toner images, which make the electrostatic latent images visible, on the surface of the photoconductor drum 121, a transfer roller 125 that rotates in contact with the photoconductor drum 121 to transfer the toner images from the surface of the photoconductor drum 121 onto the web 101, and a backup roller 126 for pressing the web 101 to the transfer roller 125.

The bias voltage, which makes it easy to generate the transition of the toner from the transfer roller 125 to the print surface of the web 101, is applied between the transfer roller 125 and the backup roller 126. The bias voltage also fulfills the function of suppressing the inverse transition of the toner transferred onto the web 101 to the transfer roller 125.

The electrophotographic print units 12 disposed in the up and down multistage manner installed on the electrophotographic printer 10 differ from each other in print color.

The long band-shaped web 101 sequentially passes though the electrophotographic print units 12 disposed in the up/down multistage manner, by means of the transport movement (the transport movement from the lower part to the upper part of the lowermost electrophotographic print units 12 in the shown example) in the longitudinal direction in the inner part (within the print device part 10A) of the electrophotographic printer 10, whereby the multi color print is realized. The lower side (the lower side in FIG. 1) in the print device part 10A is an upstream side of the web flow direction, and the upper side (the upper side in FIG. 1) thereof is a downstream side of the web transport direction.

The web 101, which is delivered from the electrophotographic print unit 12 situated at the downstream-most side of the transport direction of the web 101 (the uppermost electrophotographic print unit 12 in the shown example), among the electrophotographic print units 12 disposed in the up/down multistage manner, is guided in the opposite direction (the down direction from the upper roller 131 in the shown example) to the portion passed to the electrophotographic print unit 12 disposed in the up/down multistage manner, by means of the rollers 131 and 132 that are installed so that separate from each other in upward and downward direction in the electrophotographic printer 10. Furthermore, in the web 101, the toner is fixed by the toner fixing device 1 provided between the up and down rollers 131 and 132.

In addition, in the drawing, reference numeral 15 is a tension roller that gives tension force to the web 101 between the up and down rollers 131 and 132, and reference numeral 16 is a tension roller that gives tension force to the web 101 delivered from the lower roller 132 to the downstream side of the transport direction.

The infrared heater 17 is configured such that a reflective cover 17*c* that forms a reflective surface 17*b* making up a curved concave surface, which reflects infrared light radiated from the heater main body 17*a* toward the print surface of the web 101, is attached to the outer side of the heater main body 17*a* (the infrared lamp main body) equipped with a filament (not shown) which is heated by the application of an electric current to radiate infrared light. In the infrared heater 17, the reflective surface 17*b* of the inner surface of the reflective cover 17*c* is installed so as to face the print surface 101*a* of the web 101, thereby irradiating the portion (hereinafter, also called as "inter-unit extension part 101*c*") of the web 101 situated between the up and down print units 12 with infrared light radiated from the heater main body 17*a*.

The toner image is transferred onto the inter-unit extension part 101*c* of the web 101 by the print unit 12 situated at the upstream side of the web flow direction from the inter-unit extension part 101*c*. Moreover, the inter-unit extension part 101*c* is in the state of absorbing the carrier liquid supplied from the print unit 12 along with the transfer of the toner image.

In the print device part 10A, by irradiating the print surface 101*a* of the inter-unit extension part 101*c* of the web 101 with infrared light from the infrared heater 17, the heating energy is given to the carrier liquid and the toner absorbed in the web 101 to remove part of the carrier liquid by evaporation. In addition, by irradiating infrared light from the infrared heater 17, the melting fixation of the toner onto the web print surface 101*a* is partly progressed. As a result, when the transfer roller 125 of the print unit 12 disposed in the downstream side of the web flow direction from the inter-unit extension part 101*c* comes in contact with the web print surface 101*a*, it is possible to reduce the amount of toner which has the possibility of inversely transitioning from the web print surface 101*a* to the transfer roller 125. As a result, it is possible to prevent or mostly eliminate the inverse transition of the toner image to the transfer roller 125, whereby the print quality can be improved.

Evaporative removal of part of the carrier liquid from the web 101 effectively contributes to bring the unfixed toner present on the web print surface 101*a* closer to the fixing state with respect to the web 101 (improving the degree of fixation), that is to say, to make the inverse transition of the toner to the transfer roller 125 hardly occurs.

The partial evaporative removal of the carrier liquid from the web 101 by means of infrared light irradiation from the infrared heater 17 is performed by the following two functions. Namely, (1) the radiant heat from the infrared heater 17, and (2) infrared light is absorbed into the carrier liquid absorbed into the web 101, the infrared light causes an inner vibration in the carrier liquid due to the light energy of the infrared light, whereby the carrier liquid is heated by the friction due to the inner vibration. That is, the radiant heat from the infrared heater 17 and the light energy of infrared light giving the carrier liquid the inner vibration serve as the heating energy for heating the carrier liquid, so that the evaporation and the dry of the carrier are performed, whereby part of the carrier liquid is removed by evaporation.

In case it is configured so that the evaporative removal of the carrier liquid is performed by the irradiation of the infrared right (the radiant heat may be active), the carrier liquid absorbed into the web 101 can be effectively heated in a short time, whereby the partial evaporative removal of the carrier liquid can be effectively performed in a short time.

The partial evaporative removal of the carrier liquid performed in a short time has the advantage of being capable of suppressing the heat input of the web 101 in a small amount. As a result, it is possible to prevent the occurrence of the obstacles such as paper wrinkles or paper stretches due to residual heat.

It is preferable that the infrared heater 17 (specifically, the heater main body 17*a*) outputs infrared light having a relatively short wave length with maximum energy weave length of 1.2 to 2.5 μm. The maximum energy wavelength indicates a wavelength with maximum energy in the wavelength range of infrared light output (radiated) by the infrared heater 17.

It is preferable to use an infrared heater 17 having, for example, the filament temperature of 1400 to 2100° C. due to the application of an electric current, the maximum energy wave length of 1.2 to 1.7 μm and the maximum energy density of 120 kw/m$^2$ or an infrared heater 17 having the filament temperature of 950 to 1200° C. due to the application of an electric current, the maximum energy wave length of 2.0 to 2.5 μm and the maximum energy density of 100 kw/m$^2$. Such infrared heaters are very effective for an increase in temperature of the object to be heated in a short time. For example, the temperature of the infrared heater increases up to the temperature at which the carrier liquid can be partly removed by evaporation in about 1 to 3 seconds from the start of infrared light irradiation. Thus, such infrared heaters are advantageous for the reduction in time of the partial evaporative removal of the carrier liquid.

Furthermore, for example, there is also an advantage in that when starting after the print preparation time or the restart after the temporary stop, the occurrence of paper damage can be reduced, thereby making it possible to improve the production efficiency of printed material.

On the other hand, if the melting fixation of the toner to the web 101 progresses too much by infrared light irradiation to the inter-unit extension part 101*c* of the web 101, the ratio of the inverse transition of the toner to the transfer roller 125 of the print unit 12 on the downstream side of the web flow direction of the inter-unit extension part 101*c* declines, but the transfer of the toner image (toner image) to the web print surface 101*a* by the print unit 12 on the downstream side of the web flow direction is impeded, which results in a decline in print quality. Thus, it is preferable to adjust infrared light irradiation to the inter-unit extension part 101*c* of the web 101 so that the transfer of the toner image to the web 101 by the print unit 12 on the downstream side of the web flow direction of the inter-unit extension part 101*c* is not disturbed by the excessive progress of the toner fixation.

The print device part 10A of the electrophotographic printer 10 shown in FIG. 1 includes an infrared output control section 18 for controlling the infrared outputs of each infrared heater 17. Since the radiant heat output of the infrared heater 17 changes in conjunction with the infrared output, it is possible to control the outputs of the overall heating energies which are given to the inter-unit extension part 101*c* of the web 101 by the infrared heater 17 by controlling the infrared output.

The outputs of the heating energies which are given to the inter-unit extension part 101*c* of the web 101 by the infrared heater 17 are controlled by the infrared output control section 18 within a range in which the degree of fixation of the toner to the web 101 by the heating energy does not disturb the toner image transfer to the web 101 by the print unit 12 on the downstream side of the web flow direction of the inter-unit extension part 101*c* to which the infrared heater 17 gives the heating energy. The infrared output control section 18 functions as an energy output control section that controls the heating energy output which is given to the inter-unit extension part 101*c* of the web 101 by the infrared heater 17. It is preferable that the heating energy output of the infrared heater 17 be as high as possible within a range that does not disturb the toner image transfer from the infrared heater 17 to the web 101 in the print unit 12 on the downstream side of the web flow direction in order to prevent the inverse transition phenomenon of the toner.

The degree of fixation of the toner to the web 101 (the inter-unit extension part 101*c*) by the heating energy output by the infrared heater 17 changes depending on the print speed, the transport speed of the web 101, and the distance from the infrared heater 17 to the inter-unit extension part 101*c*.

The output control of the heating energy of the infrared heater 17 by the infrared output control section 18 is performed for each infrared heater 17 depending on the print speed, the transport speed of the web 101, and the distance from the infrared heater 17 to the inter-unit extension part 101*c*, within a range in which the degree of fixation of the toner to the web 101 by the heating energy does not disturb the toner image transfer to the web 101 by the print unit 12 on the downstream side of the web flow direction of the inter-unit extension part 101*c* to which the infrared heater 17 gives the heating energy.

Next, the toner fixing device 1 will be described.

In the elelctrophotograpic printer 10 shown in FIG. 1, the toner fixing device 1 includes a provisional fixing part 2 having a provisional fixer 20 that irradiates the surface 101*a* of the portion of the web 101 disposed between the up and down rollers 131 and 132 with the infrared light, and a main fixing part 3 installed on the downstream side (lower side of the provisional fixing part 2 in FIG. 1) of the web flow direction of the provisional fixing part 2.

The provisional fixing part 2 includes the provisional fixer 20, a heat shielding plate 21 which is disposed so as to be extended along the web 101 at the opposite side of the provisional fixer 20 via the portion of the web 101 disposed between the up and down rollers 131 and 132, and a fan 23 and a blower 24 for providing an air flow along the web 101 within a provisional fixing treatment space 22 which is a space secured between the heat shielding plate 21 and the provisional fixer 20.

The web 101 passes through the provisional fixing treatment space 22 so as to be extended along the up and down direction. The provisional fixer 20 and the heat shielding plate 21, which are opposed to each other via the provisional fixing treatment space 22, are installed separately from the portion of the web 101 passed through the provisional fixing treatment space 22 so as not to make contact the web 101.

The provisional fixer 20 is configured by attaching the infrared heater 202 and the blowing fan 203 for blowing the air to the print surface 101*a* of the web 101 to a provisional fixer main body 201 installed along the web 101.

Figure 2:
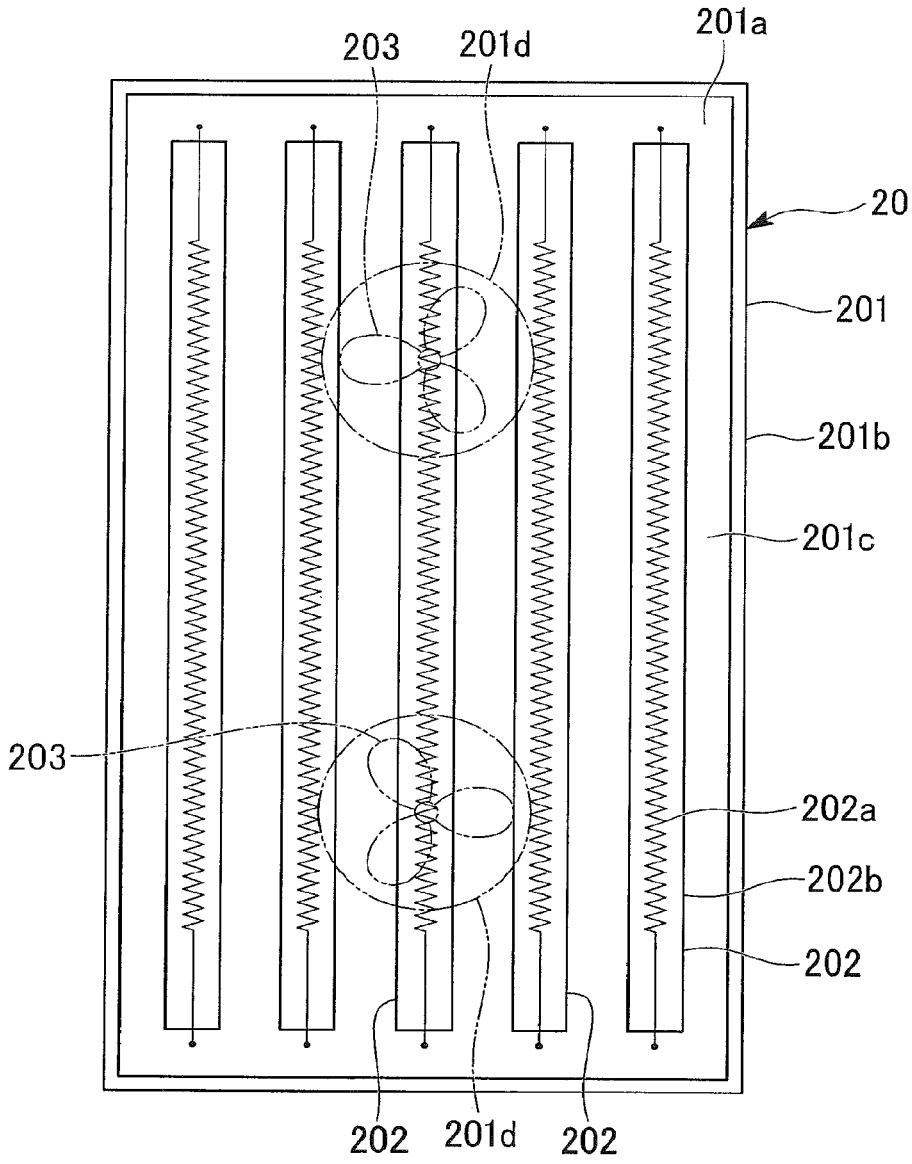
FIG. 2 is a diagram showing a provisional fixer of a toner fixing device of the electrophotographic printer in FIG. 1 when seen from the opening side thereof.

As shown in FIGS. 1 and 2, the provisional fixer main body 201 has a backboard portion 201*a* and a square frame-shaped side wall potion 201*b* disposed at the outer periphery portion of the backboard portion 201*a*. The provisional fixer main body 201 is formed in the shape of a concave cover that houses the infrared heater 202 at the inner side of the side wall portion 201*b*.

The infrared heater 202 is formed in the shape of a rod and is arranged and installed in a plurality of rows at the inner side of the provisional fixer main body 201 so as to make the longitudinal direction thereof align with the flow direction of the web 101. The plurality of infrared heaters 202 is arranged, side by side and installed on a plane, which is substantially parallel with the print surface 101*a* of the web 101 passed through the provisional fixing treatment space 22.

In addition, the number of infrared heaters 202 installed is not particularly limited.

Moreover, it is not necessarily to install the infrared heater 202 in a direction in which the longitudinal direction thereof is aligned with the flow direction of the web 101. The infrared heater 202 may be installed in the up/down multistage manner, for example, in a direction extending in the horizontal direction.

In addition, the shape of the infrared heater is not particularly limited and is not limited to the shape of a rod.

The infrared heater 202 is configured by putting a filament 202*a*, which is heated by the application of an electric current to radiate infrared light, in an infrared light permeable holding tube 202*b*. The holding tube 202*b* is, for example, formed of a material with superior infrared light permeability such as quartz glass. The filament 202*a* is put in the holding tube 202*b* over the whole length thereof in the longitudinal direction. As for the material of the filament 202*a*, for example, Kanthal line, tungsten, carbon, or the like can be used.

The provisional fixer main body 201 is installed so that an opposite side (hereinafter, also called an opening side) of the backboard portion 201*a* faces the web 101 side through the inner space (the heater housing space 201*c*) surrounded by the side wall portion 201*b*. As a result, the provisional fixer 20 can irradiate infrared light radiated from the infrared heater 202 from the opening side of the provisional fixer main body 201 to the web 101.

Furthermore, the provisional fixer main body 201 may be configured such that the inner surface of the heater housing space 201*c* is made as an infrared light reflective surface by means of the installation of a reflective plate or the like for reflecting infrared light. The provisional fixer main body 201 is formed of an infrared-light reflective material, whereby the inner surface of the heater housing space 201*c* may be an infrared light reflective surface. As a result, it is possible to irradiate the web 101 with infrared light radiated from the infrared heater 202 without any loss.

The blowing fan 203 is built in an air inlet hole 201*d* opened to the backboard portion 201*a* of the provisional fixer main body 201. The blowing fan 203 draws air outside the provisional fixer main body 201 into the provisional fixer main body 201 and blows air onto the web 101.

The air blown by the blowing fan 203 is used for the drying removal (the removal and drying by the evaporation) of the carrier liquid absorbed into the web 101. Furthermore, it also effectively contributes to overheating prevention of the provisional fixer 20.

The fan 23 and the blower 24 each function as an air flow forming device for providing an air flow from the lower end portion to the upper part in the provisional fixing treatment space 22 to exhaust a vapor which is evaporated from the web 101 by the irradiation of infrared light from the infrared heater 202 of the provisional fixer 20.

The air flow fulfills the function of discharging the carrier liquid (the vapor of the carrier liquid) evaporated from the portion of the web 101 (an area (hereinafter, also called a provisional fixing area 101*b*) provided so as to follow the overall lengths of the infrared heater 202 of the provisional fixer 20, mainly in the longitudinal direction of the web 101) passing through the provisional fixing treatment space 22, from the provisional fixing treatment space 22.

The fan 23 is installed at the lower side of the provisional fixing treatment space 22 between the heat shielding plate 21 and the provisional fixer 20 to provide the air flow from the lower end portion thereof to the upper part in the provisional fixing treatment space 22 by the air blown to the upper part. That is, the fan 23 provides the air flow, which rises along the web 101 passing through the provisional fixing treatment space 22, in the provisional fixing treatment space 22.

The fans 23 are each installed at both sides (both sides via the web 101 in the thickness direction of the web 101) via the web 101. The web 101 passes between a pair of fans 23 that is installed separately from each other at the lower side of the provisional fixing treatment space 22.

Blower 24 is installed at the upper end of the provisional fixing treatment space 22. The blower 24 absorbs and exhausts the air in the provisional fixing treatment space 22, whereby airflow is formed from the lower end portion to the upper part in the provisional fixing treatment space 22.

The toner fixing device and the electrophotographic printer according to the present invention are not limited to a configuration which adopts both of the fan 23 and the blower 24 as the air flow forming device for providing the air flow from the lower end portion to the upper part in the provisional fixing treatment space 22, may be a configuration which adopts only one of the fan 23 and the blower 24.

It is preferable that the temperature of the air (air to be transported to the provisional fixing treatment space 22 by the fan 23, in the shown example) introduced into the provisional fixing treatment space 22 for providing the air flow in the provisional fixing treatment space 22 by the air flow forming device be, for example, 10 to 40° C.

Although the air flow forming device in which provides an air flow rising in the provisional fixing treatment space 22 is described as a preferred embodiment of the present invention, an air flow forming device according to the present invention is not limited thereto. The air flow forming device may be of a type which provides the airflow in the direction (the direction along the surface of the web 101) along the web 101 in the provisional fixing treatment space 22 and, for example, may be a type of which provides an air flow dropping in the provisional fixing treatment space 22 or a type that provides a horizontal airflow.

However, if the airflow forming device has a configuration that provides the airflow rising in the provisional fixing treatment space 22 as described above, it is advantageous in smoothly discharging the vapor (the vapor rises upward from the provisional fixing area 101*b* of the web 101) of the carrier liquid, which is heated through infrared light irradiation from the infrared heater 202 of the provisional fixer 20 and is evolved from the web 101, from the provisional fixing treatment space 22.

The airflow, which is provided in the provisional fixing treatment space 22 by the fan 23 and the blower 24, comes in contact with the whole provisional fixing area 101*b* of the web 101 which passes through the provisional fixing treatment space 22. Thus, the web 101 which, is in a wet state by absorbing the carrier liquid, is effectively dried by the synergy effect of the drying performed by the irradiation of infrared light from the infrared heater 202 of the provisional fixer 20 and the drying performed by the airflow provided in the provisional fixing treatment space 22. As a result, the provisional fixing of the toner to the web 101 can be conducted in a short time.

In addition, the vapor of the carrier liquid, which is evaporated from the web 101 by the irradiation of infrared light, is smoothly exhausted from the provisional fixing treatment space 22 by means of the airflow provided in the provisional fixing treatment space 22 by the fan 23 and the blower 24. As a result, it is possible to prevent the vapor of the carrier liquid from staying within the provisional fixing treatment space 22. This also efficiently contributes to the drying of the web 101 in a short time. Furthermore, this is also effective in preventing contamination due to stagnation of the evaporation component of the residual toner.

The drying of the web 101 by the irradiation of infrared light is performed in such a way that the infrared light is absorbed into the carrier liquid absorbed in the web 101, the carrier liquid is heated by the friction due to the inner vibration owing to the light energy in the carrier liquid, thereby the carrier liquid is evaporated and the web 101 is dried. The drying method of the web 101 by the irradiation of infrared light can conduct the drying removal of the carrier liquid and the drying of the web 101 effectively in a short time due to effective short time heating of the carrier liquid absorbed in the web 101, compared with the method of the related art, for example, the method of heating the web from the surface thereof by means of only jetting and spraying of the heating wind from a plurality of penetration holes provided on the plate-shaped heater body, as described in Japanese Unexamined Utility Model Application, First Publication No. 2-51353.

In addition, as described above, by bringing the airflow, which is provided in the provisional fixing treatment space 22 by the airflow forming device, into contact with the web 101 (in particular, the provisional fixing area 101*b*), the drying of the web 101 is promoted also by means of the airflow. As a result, drying of the web 101 can be realized in a short time.

To use infrared light in the drying of the web 101 and accordingly enable the drying removal of the carrier liquid and the drying of the web 101 to be performed in a short time have the advantage of being capable of suppressing the heat input of the web 101 for drying to a small amount. As a result, it is possible to prevent the occurrence of obstacles such as paper wrinkles or paper stretches due to residual heat. In addition, the airflow provided in the provisional fixing treatment space 22 by the airflow forming device also conducts the drying removal of the carrier liquid and the drying of the web 101, so that heat input of the web 101 can be further reduced, which makes it possible to more securely prevent the occurrence of obstacles such as paper wrinkles or paper stretches due to the residual heat which affects the transport movement of the web.

Furthermore, as described above, with the configuration of the provisional fixing part 2 capable of conducting the drying removal of the carrier liquid and the drying of the web 101 in a short time, the downsizing of the provisional fixing portion 2 is also easily performed, which efficiently contributes to overall downsizing and space reductions in toner fixing device and the electrophotographic printer.

It is preferable that the infrared heater 202 outputs infrared light with the maximum energy wave length of 1.2 to 2.5 μm.

As for the infrared heater 202, it is preferable to use the infrared heater having, for example, the temperature of the filament 202*a* of 1400 to 2100° C. due to the application of an electric current, the maximum energy wave length of 1.2 to 1.7 μm and the maximum energy density of 120 kw/m$^2$ or the infrared heater having the temperature of the filament 202*a* of 950 to 1200° C. due to the application of an electric current, the maximum energy wavelength of 2.0 to 2.5 μm and the maximum energy density of 100 kw/m$^2$. Such an infrared heater is effective for increasing the temperature of the object to be heated in a short time. For example, the temperature of the web 101 can increase up to the temperature at which the carrier liquid can be dried and removed in a short time of about 1 to 3 seconds from the start of infrared light irradiation. Thus, such an infrared heater is advantageous for the reduction in time of the drying removal of the carrier liquid and the drying of the web 101.

Furthermore, for example, there is also an advantage in that the occurrence of paper damage can be reduced when starting after the print preparation time or the restart after the temporary stop, thereby making it possible to improve the production efficiency of printed materials.

In addition, in the toner fixing device 1 and the electrophotographic printer 10 of the shown example, as already mentioned, the airflow provided by the blowing fan 203 of the provisional fixer 20 is also used for the drying removal of the carrier liquid absorbed into the web 101. The blast from the blowing fan 203 is heated by being passed through the heater housing space 201*c* at the inner side of the provisional fixer main body 201 of the provisional fixer 20 and is sprayed to the web 101 (the provisional fixing area 101*b*). The air blown onto web 101 by the blowing fan 203 is extruded by the airflow provided in the provisional fixing treatment space 22 by the airflow forming device, and is discharged from the provisional fixing treatment space 22.

Next, the main fixing portion 3 will be described.

As shown in FIG. 1, the main fixing part 3 is configured by installing main fixing units 33, which press the web 101 by a pair of heating rollers 31 and 32 for a main fixing (i.e. a definitive fixing) while pinching the web therebetween, in the up/down multistage manner (six stages in FIG. 1).

The heating rollers 31 and 32 are both equipped with the infrared heater 39 and are heated by the infrared heater 39.

Figure 3:
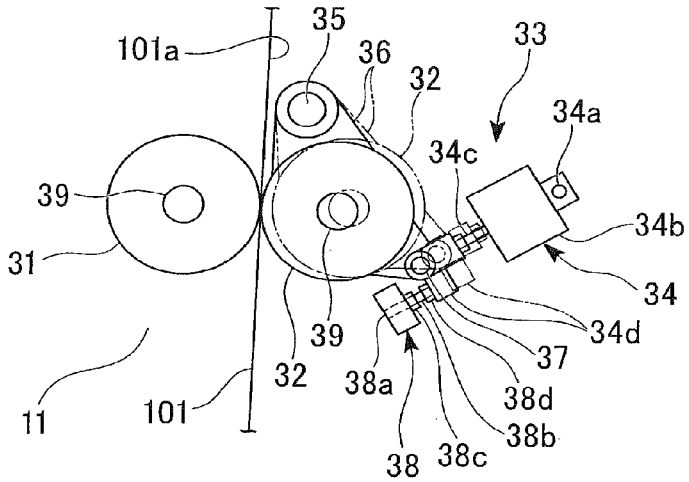
FIG. 3 is a diagram showing a configuration of a main fixing unit of a main fixing part of the toner fixing device of the electrophotographic printer in FIG. 1.

As shown in FIGS. 1 and 3, the main fixing unit 33 includes a fixing side roller 31 which is a heating roller 31 fixed to the frame 11, a pressing roller 32 which is a heating roller 32 for pressing the web 101 against the fixing side roller 31, and a pressing mechanism 34 for pressing the pressing roller 32 against the fixing side roller 31.

Figure 4:
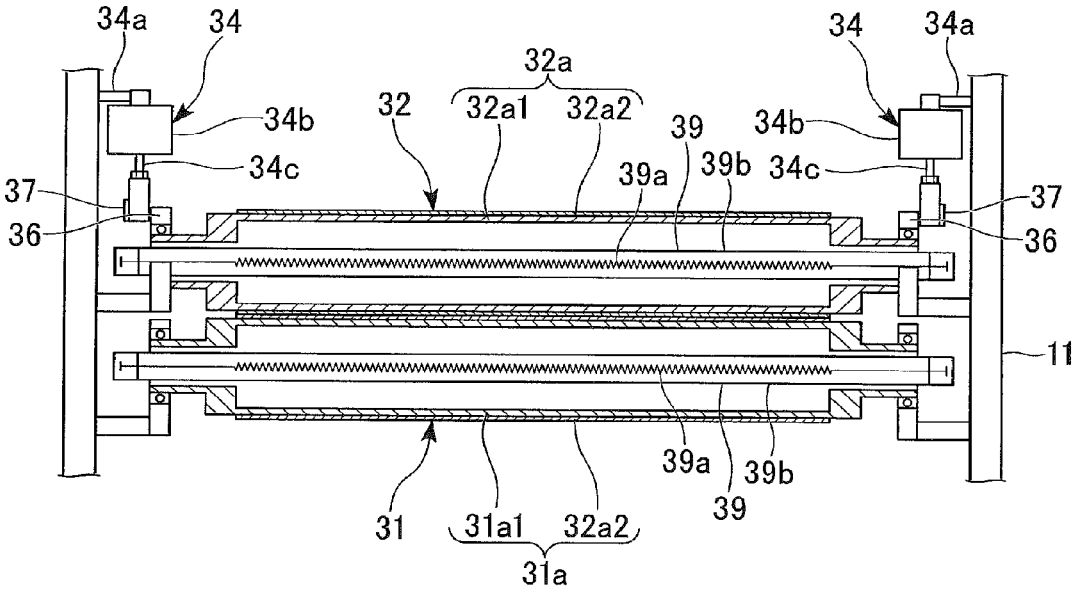
FIG. 4 is a sectional view showing a structure of the main fixing unit in FIG. 3.

In the main fixing unit 33 as shown in FIGS. 3 and 4, both ends of the pressing roller 32 in the axial center direction are rotatably attached to a bracket 36 which is rotatably attached to a rotation axis 35 provided on the frame 11. Such configuration allows the pressing roller 32 to rotate around the rotation axis 35 integrally with the bracket 36. Specifically, the pressing mechanism 34 is a driving cylinder device (hereinafter, when the pressing mechanism indicates the driving cylinder device, the pressing mechanism is also called the driving cylinder device) and has the following configuration. That is, the front end of a piston shaft 34*c*, which is protruded from the cylinder main body 34*b* connected to the frame 11 with a pin (a pin connected portion 34*a*), is rotatably connected to the bracket 36 via the pin 37. The protrusion of the piston shaft 34*c* from the cylinder main body 34*b* allows the pressing roller 32 to be pressed toward the fixing side roller 31. As a result, it is possible to press the web 101 with the pair of heating rollers 31 and 32 while pinching the web 101 therebetween.

The main fixing unit 33 of the main fixing part 3 has a stopper 38 with which a contact piece 34*d* provided at the front end of the piston shaft 34*c* of the driving cylinder device 34 makes contact when the pressing roller 32 is pressed toward the fixing side roller 31.

The stopper 38 is fixedly provided to the frame 11. The stopper 38 includes a fixing block 38*a* fixed to the frame 11, a bolt 38*b* which is threadably mounted on the fixing block 38*a* and can change the protrusion size from the fixing block 38*a* by the rotation operation, a fixing nut 38*c* that is threadably mounted on the bolt 38*b* and is tightly fastened to fix the bolt 38*b* to the fixing block 38*a*, and a head portion 38*d* which is formed at the front end protruded from the fixing block 38*a* of the bolt 38*b* and with which the contact piece 34*d* of the front end of the piston shaft 34*c* of the driving cylinder device 34 makes contact.

In the main fixing unit 33, by changing the screw fixing position of the bolt 38*b* with respect to the fixing block 38*a* to change the protrusion size of the bolt 38*b* from the fixing block 38*a*, it is possible to adjust the pressing force in which the pair of heating rollers 31 and 32 press the web 101 while pinching it therebetween.

When the piston shaft 34*c* is inserted into the cylinder main body 34*b* from a state (a state indicated by a solid line in FIG. 3) in which the web 101 is pressed between the pair of heating rollers 31 and 32 while being pinched therebetween to reduce the protrusion amount of the piston shaft 34*c* from the cylinder main body 34*b*, as shown by chain double-dashed line in FIG. 3, the contact piece 34*d* of the front end of the piston shaft 34*c* is separated from the head portion 38*d* of the bolt 38*b* of the stopper 38. When the contact piece 34*d* is separated from the head portion 38*d*, it can move so as to separate the pressing roller 32 from the fixing side roller 31. As a result, the state, in which the web 101 is pressed between the pair of heating rollers 31 and 32 while being pinched therebetween, can be released, which makes it possible to secure a distance capable of conducting an insertion and an extraction of the web 101 between the pair of heating rollers 31 and 32.

When the piston shaft 34*c* is protruded from the cylinder main body 34*b* from the state in which the contact piece 34*d* of the front end of the piston shaft 34*c* of the driving cylinder device 34 is separated from the stopper 38 (specifically, separated from the head portion 38*d* of the bolt 38*b*), the pressing roller 32 approaches the fixing side roller 31. The approach of the pressing roller 32 with respect to the fixing side roller 31 stops when contact piece 34*d* of the front end of the piston shaft 34*c* comes in contact with the stopper 38 (specifically, comes in contact with the head portion 38*d* of the bolt 38*b*).

The movement of the pressing roller 32 due to the protrusion and the insertion of the piston shaft 34*c* of the driving cylinder device 34 (the rotation around the rotation shaft 35) is performed by maintaining the state in which the axial center of the pressing roller 32 and the axial center of the fixing side roller 31 are parallel to each other. The web 101 is pressed by pinching the web 101 from both sides in the width direction with the pair of heating rollers 31 and 32.

As shown in FIGS. 3 and 4, the pressing roller 32 is configured such that the infrared heater 39 is put in an inner portion of an outer trunk 32*a* which is formed by covering the outer peripheral surface of a metallic cylinder 32*a*1 with a rubber covering layer 32*a*2. The infrared heater 39 has the same structure as the infrared heater 202 of the provisional fixer 20. That is, the infrared heater 39 has a rod-shaped structure in which the filament 39*a*, which is heated by the application of an electric current to radiate infrared light, is put in an infrared light permeable holding tube 39*b*. The filament 39*a* which can be used as the filament 202*a* of the infrared heater 202 of the provisional fixer 20 can be adopted. The filament 39*a* is put in the holding tube 39*b* for over the whole length in the longitudinal direction thereof. The infrared heater 39 is disposed on the center axis of the outer trunk 32*a* of the pressing roller 32 and is provided over the whole length of the outer trunk 32*a* in the axial center direction. The outer trunk 32*a* of the pressing roller 32 is heated by infrared light radiated from the filament 32*b* that is heated by the application of an electric current.

The fixing side roller 31 of the main fixing unit 33 has the same structure as the pressing roller 32. In FIG. 3, reference numeral 31*a* shows an outer trunk of the fixing side roller 31. The outer trunk 31*a* is configured by covering the outer peripheral surface of a metallic cylinder 31*a*1 with a rubber covering layer 31*a*2. The fixing side roller 31 is configured by holding the infrared heater 39 within the outer trunk 31*a*. In the fixing side roller 31, the infrared heater 39 is disposed on the axial center of the outer trunk 31*a* of the fixing side roller 31 and is provided over the whole length of the outer trunk 31*a* in the axial center direction. The outer trunk 31*a* of the fixing side roller 31 is heated by infrared light radiated from the filament which is heated by the application of an electric current.

The main fixing unit 33 pinches and presses the web 101 by the pair of heating rollers 31 and 32 heated by the infrared heater 39, which securely enables the toner to be fixed to the web 101 by thermocompression bonding. As described above, a configuration that performs the thermocompression bonding with the pair of heating rollers 31 and 32 can satisfactorily secure the surface property in the print surface 101*a* of the web 101. As a result, it is possible to realize the satisfactory fixing which both fulfils the satisfactory surface property and drying on the print surface 101*a*.

It is preferable for the infrared heater 39 to output infrared light with the maximum energy wavelength of 1.2 to 2.5 μm in the same manner as the infrared heater 202 of the provisional fixer 20.

As for the infrared heater 39, it is preferable to use an infrared heater having, for example, the temperature of the filament 39*a* of 1400 to 2100° C. by the application of an electric current, the maximum energy wave length of 1.2 to 1.7 μm and the maximum energy density of 120 kw/m$^2$ or the infrared heater having the temperature of the filament 39*a* of 950 to 1200° C. by the application of an electric current, the maximum energy wave length of 2.0 to 2.5 μm and the maximum energy density of 100 kw/m$^2$.

Since such infrared heaters are effective for increasing the temperature of the object to be heated in a short time, for example, when starting after the print preparation time or the restart after the temporary stop, the occurrence of paper damage can be reduced. This makes it possible to improve the production efficiency of the printed material.

Furthermore, it is possible to increase the temperature of the portion, which contacts with the web 101 of the outer trunk of the heating rollers 31 and 32, whereby the temperature decreases, until it makes contact with the web 101 again by the rotation of the heating rollers 31 and 32, up to the predetermined temperature in a short time. Such increase in temperature also efficiently contributes to the stabilization of the surface temperatures of the heating rollers 31 and 32.

As shown in FIG. 1, the main fixing part 3 includes a plurality of main fixing units 33, and goes the web 101 through the plurality of main fixing units 33 to conduct the main fixing (the definitive fixing) of the toner with respect to the web 101 by the thermocompression bonding in the respective main fixing units 33. With the configuration, by setting the installation number of the main fixing unit 33 depending on the installation number or the print speed of the electrophotopraphic print unit 12 in the electrophotographic printer 10, it is possible to obtain a stable fixing state without non-uniformity. In addition, since the heating and the pressurization of the web 101 are dividedly performed several times by the plurality of main fixing units 33, it is possible to easily and securely obtain a stable fixing state without non-uniformity. In addition, it is possible to suppress the occurrence of obstacles such as paper wrinkles or paper stretches in the recording material (the web 101).

The toner fixing device 1 can also adjust the provisional fixing part 2 so as to be able to obtain a stable fixing state without non-uniformity depending on the installation number or the print speed of the electrophotopraphic print unit 12 in the electrophotographic printer 10 by adjusting the size (particularly, the size in the direction along the flow direction of the web 101) of the provisional fixer 20.

The toner fixing device 1 has the composition in which the provisional fixing part 2 is provided at the upper side of the main fixing part 3 with the plurality of main fixing units 33 installed in the up/down multistage manner. For this reason, it is possible to freely assemble with the composition (the selection of the size of the provisional fixer 20 and/or the setting of the installation number of the main fixing unit 33) correspond to the printing conditions such as the number of print colors or the print speed in a certain space in the transverse direction of the printer. As a result, it is possible to provide the system with excellent quality and economic efficiency without any loss of print quality, production efficiency, installation space and equipment costs.

In addition to the application of the bias voltage between the transfer roller 125 of the print unit 12 and the backup roller 126, the electrophotographic printer 10 performs the partial removal of the carrier liquid, which is absorbed into the inter-unit extension part 101*c* of the web 101 transported in the print device part 10A and the partial melting fixation of the toner, by the heating energy output from the infrared heater 17. With such composition, it is possible to effectively suppress the inverse transition phenomenon of the toner from the web 101 to the transfer roller 125 of the print unit 12, whereby the improvement and the advancement of the print quality can be realized.

As a result, it is possible to stably maintain the excellent print quality in the wide speed range from low speed regions to high speed regions.

In the electrophotographic printer 10, the web 101 of the state in which the removal of the carrier liquid and the fixing of the toner progress in a degree by the heating energy of the infrared heater 17 on the print device part 10A is supplied to the toner fixing device 1 by the transport movement. As a result, it is also possible to realize downsizing and simplification of the toner fixing deice 1.

In addition, the electrophotographic printer 10 is configured to perform the drying removal of the carrier liquid from the web 101 and the fixing of the toner stage by stage by means of the print device part 10A (the infrared heater 17), the provisional fixing part 2 and the main fixing part 3. For this reason, there is an advantage in that it is possible to reduce the stress applied to the web 101 by the heating for the drying removal of the carrier liquid and the fixing of the toner, whereby obstacles such as paper wrinkles or paper stretches hardly occurs.

Because the print device portion 10A has a configuration with the print units 12 in the up/down multistage manner, it is possible to assemble the print device portion 10A with a configuration (setting of the installation number of the print unit) correspond to the printing conditions such as the number of print colors or the print speed in a certain space in the transverse direction of the printer. For this reason, it is possible to construct the system with excellent quality and economical efficiency without any loss of print quality, production efficiency, installation space and equipment costs.

In addition, the present invention is not limited to the above-mentioned embodiment, but any design change thereof can be suitably made without departing from the spirit or scope of the invention.

The print device part is not limited to a configuration in which a plurality of print units with different print colors is provided for performing the multi-color printing, but, for example, can adopt a configuration including a plurality of print units with an identical print color, or a configuration in which the print colors of the overall print units are the same to perform a single color overlap printing or the like.

Although the infrared heater has been described as the fixing auxiliary mechanism in the above-mentioned embodiment, the fixing auxiliary mechanism relating to the present invention is not limited thereto. For example, it is also possible to adopt a heater (an electric heat heater) for heating the web with the radiant heat from an electric current application heating element such as an electric heat line, a warm wind heater or the like.

The toner fixing device may have a configuration capable of conducting the drying removal of the carrier liquid absorbed into the web and the melting fixation of the toner to the web, and is not limited to the toner fixing device including the provisional fixing part and the main fixing part as in the above-mentioned embodiment, but can adopt various configurations.

In the above-mentioned embodiment, at the upper side of the main fixing part 3 having a configuration with a plurality of main fixing units 33 provided in the up/down multistage manner, the toner fixing device 1 with the provisional fixing part 2 installed thereon and the electrophotographic printer 10 have been described. However, the electrophotographic printer according to the present invention may have a configuration which includes the provisional fixing part having the provisional fixer for performing the provisional fixing by the irradiation of infrared light, and the main fixing part for performing the main fixing (the definitive fixing) of the toner by pressing the web with the plurality of rollers including the heating roller for the main fixing (the definitive fixing) while pinching the web therebetween. Thus, the positional relationship of the provisional fixing part and the main fixing part, the installation number of the main fixing unit of the main fixing part, and the installation position are not limited to the configuration described in the above-mentioned embodiment.

In the above-mentioned embodiment, the description has been given for a configuration in which, regarding to the main fixing unit 33, the web is pressed by the pair of heating rollers 31 and 32 with the web pinched therebetween to perform the main fixing (the definitive fixing). However, as for the main fixing unit, it is also possible to adopt a configuration which includes the heating roller and a roller (a roller that is not provided with the heating function) other than the heating roller, as the roller for nipping the web.

In addition, the heating roller provided on the main fixing part is not limited to a configuration equipped with the infrared heater as described in the above-mentioned embodiment. The present invention can also adopt a known heating roller for toner fixing in the wet type electrophotographic printer as the heat roller.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. An electrophotographic printer comprising:

a plurality of connected electrophotographic print units that has photoconductor drums on which toner images are formed and transfer rollers which transfer the toner images of the photoconductor drums onto a recording material; and a fixing auxiliary mechanism provided between the electrophotographic print units in the flow direction of the recording material, wherein the fixing auxiliary mechanism applies heating energy to a toner and a carrier liquid absorbed in the recording material to remove part of the carrier liquid by evaporation, and enhances a degree of fixation of the toner onto the print surface of the recording material; and wherein the fixing auxiliary mechanism is an infrared heater for irradiating the print surface of the recording material with infrared light; and wherein the infrared heater outputs infrared light with a maximum energy wavelength of 1.2 to 2.5 μm.

2. The electrophotographic printer according to claim 1, further comprising:

an energy output control section that controls the output of heating energy to be applied to the toner and the carrier liquid of the recording material by the fixing auxiliary mechanism within a range in which the degree of fixation of the toner to the recording material by the heating energy does not disturb the image transfer onto the recording material by the electrophotographic print unit of the downstream side of the recording material flow direction of the fixing auxiliary mechanism.

3. The electrophotographic printer according to claim 1, wherein the electrophotographic print units include backup rollers which press the recording material to the transfer rollers, and wherein a bias voltage is applied between the transfer rollers and the backup rollers of the electrophotographic print units.

4. The electrophotographic printer according to claim 1, wherein the electrophotographic print units are provided in up/down multistage manner.

5. The electrophotographic printer according to claim 1, wherein the electrophotographic print units are different colors.

6. The electrophotographic printer according to claim 1, further comprising a toner fixing device that performs drying removal of the carrier liquid and toner fixing of the recording material in which the print by the electrophotographic print unit is completed.

7. The electrophotographic printer according to claim 2, further comprising a toner fixing device that performs the drying removal of the carrier liquid and the toner fixing of the recording material in which the print by the electrophotographic print unit is completed.

8. The electrophotographic printer according to claim 3, further comprising a toner fixing device that performs the drying removal of the carrier liquid and the toner fixing of the recording material in which the print by the electrophotographic print unit is completed.

9. The electrophotographic printer according to claim 4, further comprising a toner fixing device that performs the drying removal of the carrier liquid and the toner fixing of the recording material in which the print by the electrophotographic print unit is completed.

10. The electrophotographic printer according to claim 5, further comprising a toner fixing device that performs the drying removal of the carrier liquid and the toner fixing of the recording material in which the print by the electrophotographic print unit is completed.

11. The electrophotographic printer according to claim 6, wherein the toner fixing device includes a provisional fixing part and a main fixing part, the provisional fixing part having a provisional fixer installed thereon which includes an infrared heater for irradiating the print surface of the recording material that is transported in the electrophotographic printer with infrared light, and the main fixing part having one or more main fixing units that are provided on the downstream side of the recoding material flow direction of the provisional fixing part and press the recording material while pinching the recording material therebetween by a plurality of rollers including a heating roller.

12. The electrophotographic printer according to claim 7, wherein the toner fixing device includes a provisional fixing part and a main fixing part, the provisional fixing part having a provisional fixer installed thereon which includes an infrared heater for irradiating the print surface of the recording material that is transported in the electrophotographic printer with infrared light, and the main fixing part having one or more main fixing units that are provided on the downstream side of the recoding material flow direction of the provisional fixing part and press the recording material while pinching the recording material therebetween by a plurality of rollers including a heating roller.

13. The electrophotographic printer according to claim 8, wherein the toner fixing device includes a provisional fixing part and a main fixing part, the provisional fixing part having a provisional fixer installed thereon which includes an infrared heater for irradiating the print surface of the recording material that is transported in the electrophotographic printer with infrared light, and the main fixing part having one or more main fixing units that are provided on the downstream side of the recoding material flow direction of the provisional fixing part and press the recording material while pinching the recording material therebetween by a plurality of rollers including a heating roller.

14. The electrophotographic printer according to claim 9, wherein the toner fixing device includes a provisional fixing part and a main fixing part, the provisional fixing part having a provisional fixer installed thereon which includes an infrared heater for irradiating the print surface of the recording material that is transported in the electrophotographic printer with infrared light, and the main fixing part having one or more main fixing units that are provided on the downstream side of the recoding material flow direction of the provisional fixing part and press the recording material while pinching the recording material therebetween by a plurality of rollers including a heating roller.

15. The electrophotographic printer according to claim 10, wherein the toner fixing device includes a provisional fixing part and a main fixing part, the provisional fixing part having a provisional fixer installed thereon which includes an infrared heater for irradiating the print surface of the recording material that is transported in the electrophotographic printer with infrared light, and the main fixing part having one or more main fixing units that are provided on the downstream side of the recoding material flow direction of the provisional fixing part and press the recording material while pinching the recording material therebetween by a plurality of rollers including a heating roller.

* * * * *